US007905102B2

(12) United States Patent
Bodell, II et al.

(10) Patent No.: US 7,905,102 B2
(45) **Date of Patent: *Mar. 15, 2011**

(54) CONTROL SYSTEM

(75) Inventors: Mark R. Bodell, II, York, PA (US); Robert E. Stabley, IV, Dallastown, PA (US); Wanda J. Miller, Mequon, WI (US)

(73) Assignee: Johnson Controls Technology Company, Holland, MI (US)

( * ) Notice: Subject to any disclaimer, the term of this patent is extended or adjusted under 35 U.S.C. 154(b) by 428 days.

This patent is subject to a terminal disclaimer.

(21) Appl. No.: 12/102,459

(22) Filed: Apr. 14, 2008

(65) Prior Publication Data

US 2008/0253877 A1 Oct. 16, 2008

Related U.S. Application Data

(63) Continuation-in-part of application No. 10/683,772, filed on Oct. 10, 2003, now Pat. No. 7,356,999.

(51) Int. Cl.

| | |
|---|---|
| ***F25B 1/00*** | (2006.01) |
| ***F25B 49/00*** | (2006.01) |
| ***F01B 25/00*** | (2006.01) |
| ***F01D 17/00*** | (2006.01) |

(52) U.S. Cl. ..... 62/228.3; 62/228.5; 415/47; 415/119; 415/146; 415/148

(58) Field of Classification Search ..... 62/217, 62/228.3, 228.5, 228.1; 415/13, 47, 119, 415/146, 148

See application file for complete search history.

(56) References Cited

U.S. PATENT DOCUMENTS

| | | | |
|---|---|---|---|
| 3,128,852 | A | 4/1964 | Chell et al. |
| 3,362,624 | A | 1/1968 | Endress |
| 3,392,655 | A | 7/1968 | Chambers et al. |
| 4,212,585 | A | 7/1980 | Swarden et al. |
| 4,248,055 | A | 2/1981 | Day, III et al. |
| 4,503,684 | A | 3/1985 | Mount et al. |
| 4,608,833 | A | 9/1986 | Kountz |
| 4,611,969 | A | 9/1986 | Zinsmeyer |

(Continued)

FOREIGN PATENT DOCUMENTS

| | | | |
|---|---|---|---|
| EP | 0896157 | A1 | 2/1999 |

(Continued)

OTHER PUBLICATIONS

Langill, A. W.: "Microprocessor-Based Control of Large Constant-Speed Centrifugal Compressors", Proceedings of the International Instrumentation Symposium, 1982, vol. 2, pp. 591-602.

(Continued)

*Primary Examiner* — Marc E Norman

(74) *Attorney, Agent, or Firm* — McNees Wallace & Nurick LLC

(57) ABSTRACT

A stability control algorithm is provided for a centrifugal compressor. The stability control algorithm is used to control a variable geometry diffuser and a hot gas bypass valve (when provided) in response to the detection of compressor instabilities. The stability control algorithm can adjust the position of a diffuser ring in the variable geometry diffuser in response to the detection of a surge condition or a stall condition. The diffuser ring in the variable geometry diffuser can be adjusted to determine an optimal position of the diffuser ring. The stability control algorithm can also be used to open a hot gas bypass valve in response to the detection of continued surge conditions.

20 Claims, 7 Drawing Sheets

U.S. PATENT DOCUMENTS

| | | | | |
|---|---|---|---|---|
| 4,697,980 | A | 10/1987 | Keyes, IV et al. | |
| 4,900,232 | A | 2/1990 | Dziubakowski et al. | |
| 5,005,353 | A | 4/1991 | Acton et al. | |
| 5,146,764 | A | 9/1992 | Bauman et al. | |
| 5,190,440 | A | 3/1993 | Maier et al. | |
| 5,199,856 | A | 4/1993 | Epstein et al. | |
| 5,437,539 | A | 8/1995 | Gysling et al. | |
| 5,594,665 | A | 1/1997 | Walter et al. | |
| 5,658,125 | A | 8/1997 | Burns et al. | |
| 5,730,580 | A | 3/1998 | Japikse | |
| 5,947,680 | A | 9/1999 | Harada et al. | |
| 6,036,432 | A | 3/2000 | Sishtla et al. | |
| 6,129,511 | A | 10/2000 | Salvage et al. | |
| 6,139,262 | A | 10/2000 | Ravidranath | |
| 6,203,275 | B1 | 3/2001 | Kobayashi et al. | |
| 6,231,301 | B1 | 5/2001 | Barnett et al. | |
| 6,427,464 | B1 | 8/2002 | Beaverson et al. | |
| 6,506,010 | B1 | 1/2003 | Yeung et al. | |
| 6,872,050 | B2 | 3/2005 | Nenstiel | |
| 7,356,999 | B2 * | 4/2008 | Bodell et al. | 62/228.3 |
| 7,824,148 | B2 | 11/2010 | Tetu et al. | |
| 2001/0014837 | A1 | 8/2001 | Escuret et al. | |
| 2002/0076656 | A1 | 6/2002 | Huang et al. | |
| 2002/0094267 | A1 | 7/2002 | Kim et al. | |
| 2002/0161550 | A1 | 10/2002 | Bharadwaj et al. | |
| 2004/0109757 | A1 | 6/2004 | Nenstiel | |
| 2005/0076656 | A1 | 4/2005 | Bodell, II et al. | |
| 2010/0263391 | A1 | 10/2010 | Tetu et al. | |

FOREIGN PATENT DOCUMENTS

| | | | |
|---|---|---|---|
| EP | 1256726 | A1 | 11/2002 |
| EP | 1321679 | A1 | 6/2003 |
| JP | 5157095 | A | 6/1993 |
| JP | 2002371989 | | 12/2002 |
| WO | 90/10148 | | 9/1990 |
| WO | 97/00381 | | 1/1997 |
| WO | 2004/018880 | A1 | 3/2004 |
| WO | 2004/053336 | A1 | 6/2004 |

OTHER PUBLICATIONS

Eveker, et al.: "Control of Compression System Surge and Rotating Stall: A Laboratory-Based Hands-On Introduction", Proceedings of the American Control Conference, Jun. 1993, vol. 1, pp. 1307-1311.

Willems et al.: "Modeling and Control of Rotating Stall and Surge: An Overview", Proceedings of the 1998 IEEE International Conference on Control Applications, Sep. 1998, vol. 1, pp. 331-335.

De Jager, B.: "Rotating Stall and Surge Control: A Survey", Proceedings of the 34th IEEE Conference on Decision and Control, Dec. 1995, vol. 2, pp. 1857-1862.

Day et al.: "Centrifugal Compressor Multi-Mode Rotating Stall Control", Proceedings of the International Compressor Engineering Conference, Jul. 2000, pp. 47-54.

* cited by examiner

CONTROL SYSTEM

CROSS-REFERENCE TO RELATED APPLICATIONS

This application is a continuation-in-part of application Ser. No. 10/683,772, entitled SYSTEM AND METHOD FOR STABILITY CONTROL IN A CENTRIFUGAL COMPRESSOR, filed Oct. 10, 2003.

BACKGROUND

The application generally relates to a control system. The application relates more specifically to systems and methods for controlling a variable geometry diffuser mechanism of a centrifugal compressor in response to compressor instability conditions.

A centrifugal compressor may encounter instabilities such as surge conditions or stall conditions during the operation of the compressor. Surge or surging is an unstable condition that may occur when a centrifugal compressor is operated at light loads and high pressure ratios. Surge is a transient phenomenon having oscillations in pressures and flow, and, in some cases, the occurrence of a complete flow reversal through the compressor. Surging, if uncontrolled, can cause excessive vibrations in both the rotating and stationary components of the compressor, and may result in permanent compressor damage. One technique to correct or remedy a surge condition may involve the opening of a hot gas bypass valve to return some of the discharge gas of the compressor to the compressor inlet to increase the flow at the compressor inlet.

Rotating stall in a centrifugal compressor can occur in the rotating impeller of the compressor or in the stationary diffuser of the compressor downstream from the impeller. In both cases, the presence of rotating stall can adversely affect performance of the compressor and/or system. Mixed flow centrifugal compressors with vaneless radial diffusers can experience diffuser rotating stall during some part, or in some cases, all of their intended operating range. Typically, diffuser rotating stall occurs because the design of the diffuser is unable to accommodate all flows without some of the flow experiencing separation in the diffuser passageway. Diffuser rotating stall results in the creation of low frequency sound energy or pulsations. The pulsations may have high magnitudes in the gas flow passages and may result in the premature failure of the compressor, its controls, or other associated parts/systems. One technique to correct or remedy a stall condition in a centrifugal compressor may involve the closing of the diffuser space in a variable geometry diffuser. Closing of the diffuser space may also enhance the compressor's ability to resist surge conditions. However, excessive closure of the diffuser gap can reduce the flow rate or capacity through the compressor.

SUMMARY

The present invention relates to a liquid chiller system having a centrifugal compressor configured to compress a refrigerant vapor. The centrifugal compressor has a compressor inlet to receive uncompressed refrigerant vapor and a compressor exit to discharge compressed refrigerant vapor. Internally, the compressor has a diffuser that has an adjustable diffuser ring to vary the flow passage of the compressed refrigerant vapor through the diffuser. The liquid chiller system also includes an optional hot gas bypass valve connected between the compressor exit and inlet. The optional hot gas bypass valve is configured to permit a portion of the compressed refrigerant vapor to flow to the compressor inlet from the compressor exit, which is used to maintain a minimum refrigerant vapor flow rate through the compressor. The liquid chiller system further includes a stability control system to control the diffuser and the optional hot gas bypass valve to maintain stable operation of the centrifugal compressor. The stability control system has a stall reacting state to control the diffuser ring in response to detecting a stall condition in the centrifugal compressor, a surge reacting state to control the diffuser ring in response to detecting a surge condition in the centrifugal compressor, a hot gas override state to control the optional hot gas bypass valve in response to detecting a second surge condition in the centrifugal compressor, and a probing state to control the diffuser ring to obtain an optimal position for the diffuser ring.

The present invention further relates to a chiller system having a compressor, a condenser, and an evaporator connected in a closed refrigerant circuit. The compressor includes a compressor inlet to receive uncompressed refrigerant vapor from the chiller system, a compressor outlet to discharge compressed refrigerant vapor to the chiller system, and a diffuser being disposed adjacent to the compressor outlet. The diffuser having a diffuser space configured to permit passage of compressed refrigerant vapor to the compressor outlet and a diffuser ring adjustably positioned in the diffuser space to vary a size of the diffuser space to control flow of compressed refrigerant vapor through the diffuser space. The chiller system also includes a stability control system to control the position of the diffuser ring in the diffuser space in response to the detection of stall conditions and surge conditions in the compressor to maintain stable operation of the compressor.

The present invention also relates to a stability control system for maintaining stable operation of a centrifugal compressor having a compressor inlet, a compressor outlet and a variable geometry diffuser with an adjustable flow passage. The stability control system having a stall reacting state to adjust a flow passage of a variable geometry diffuser in response to detecting a stall condition in a centrifugal compressor and a surge reacting state to adjust a flow passage of a variable geometry diffuser in response to detecting a surge condition in a centrifugal compressor.

The present invention further relates to a method of providing stability control in a centrifugal compressor having a variable geometry diffuser with an adjustable flow passage. The method including the steps of repeatedly detecting for a surge condition in a centrifugal compressor during operation of a centrifugal compressor; repeatedly detecting for a stall condition in a centrifugal compressor during operation of a centrifugal compressor; continuously closing a flow passage of a variable geometry diffuser in response to the detection of a surge condition in a centrifugal compressor for a predetermined surge reaction time period; and continuously closing a flow passage of a variable geometry diffuser in response to the detection of a stall condition in a centrifugal compressor until the detected stall condition is corrected or a surge condition is detected.

The present invention also relates to a control system to maintain stable operation of a compressor. The control system includes at least one first control state configured to close a flow passage of a diffuser of the compressor in response to detecting one of a stall condition or a surge condition in the compressor. The control system also includes a second control state configured to open the flow passage of the diffuser of the compressor in response to determining an absence of a stall condition or a surge condition.

The present invention further relates to method of providing stability control in a centrifugal compressor. The method includes repeatedly detecting for a surge condition during operation of the centrifugal compressor and repeatedly detecting for a stall condition during operation of a centrifugal compressor. The method also includes closing a flow passage of a diffuser of the centrifugal compressor in response to detecting a surge condition or a stall condition in the centrifugal compressor and opening the flow passage of the diffuser of the centrifugal compressor in response to detecting an absence of a stall condition or a surge condition.

The present invention also relates to a vapor compression system. The vapor compression system includes a compressor, a first heat exchanger, and a second heat exchanger connected in a closed loop. The compressor includes an inlet to receive uncompressed vapor, an outlet to discharge compressed vapor and a diffuser being disposed near the outlet. The diffuser having a passageway configured to permit flow of compressed vapor to the outlet and a ring adjustably positioned in the passageway to vary a dimension of the passageway to control flow of compressed vapor through the passageway. The vapor compression system also includes a control system to adjust the position of the ring in the passageway in response to one of a presence of stall conditions and surge conditions in the compressor or an absence of stall conditions and surge conditions in the compressor.

DETAILED DESCRIPTION OF THE EXEMPLARY EMBODIMENTS

Figure 1:
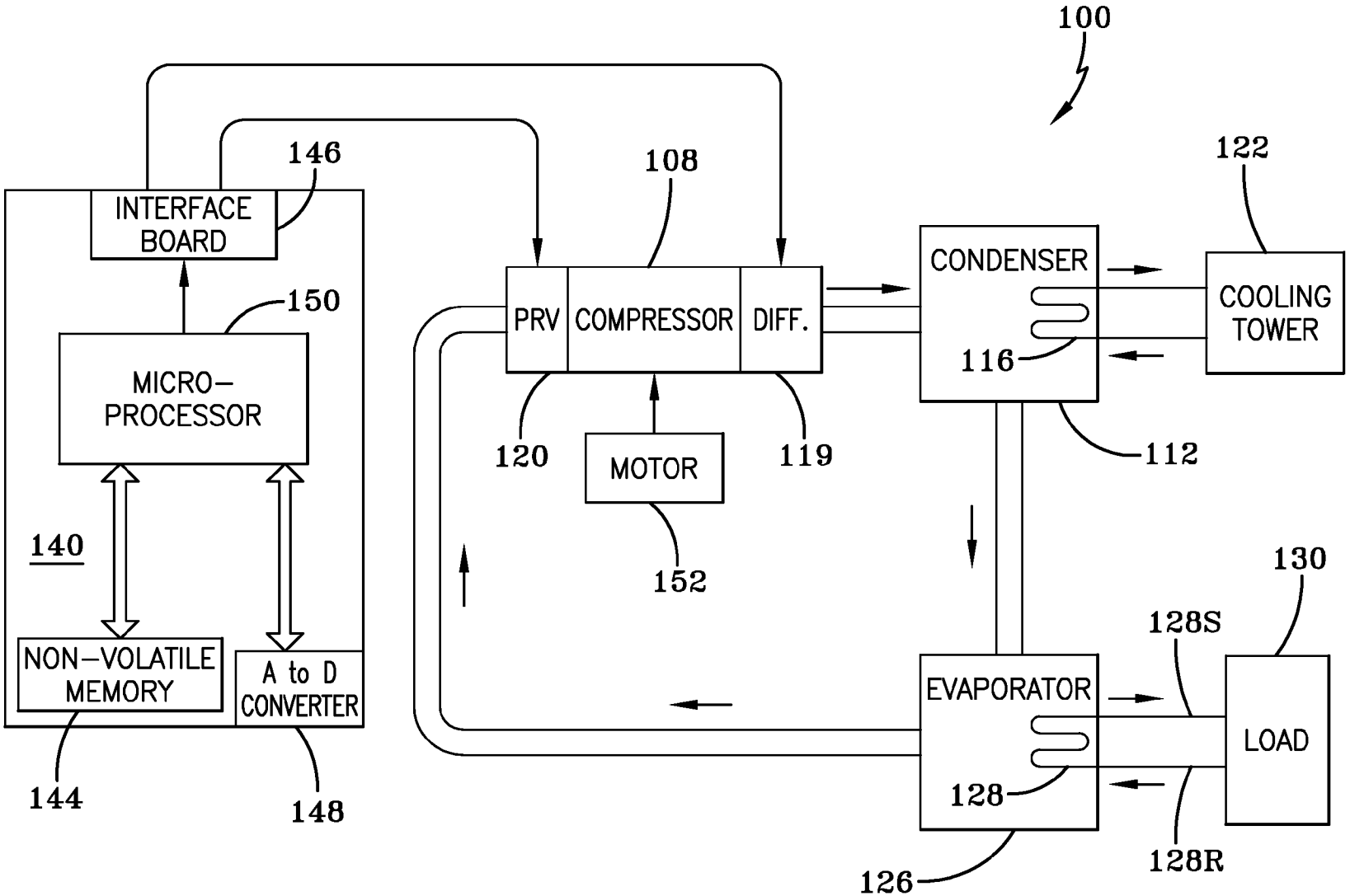
FIG. 1 schematically shows an exemplary embodiment of a vapor compression system.

FIG. 1 schematically shows an exemplary vapor compression system that may be used in heating, ventilation and air conditioning (HVAC), refrigeration or liquid chiller systems. Vapor compression system 100 can circulate a fluid, e.g., a refrigerant, through a compressor 108 driven by a motor 152, a condenser 112, an expansion device (not shown), and an evaporator 126. System 100 can also include a control panel 140 that can have an analog to digital (A/D) converter 148, a microprocessor 150, a non-volatile memory 144, and an interface board 146. Some examples of fluids that may be used as refrigerants in vapor compression system 100 are hydrofluorocarbon (HFC) based refrigerants (e.g., R-410A), carbon dioxide ($CO_2$; R-744), and any other suitable type of refrigerant.

Motor 152 used with compressor 108 can be powered by a variable speed drive (VSD) or can be powered directly from an alternating current (AC) or direct current (DC) power source. A variable speed drive, if used, receives AC power having a particular fixed line voltage and fixed line frequency from the AC power source and provides power having a variable voltage and frequency to the motor. Motor 152 can be any type of electric motor that can be powered by a VSD or directly from an AC or DC power source. For example, motor 152 can be a switched reluctance motor, an induction motor, an electronically commutated permanent magnet motor, or any other suitable motor type. In an alternate embodiment, other drive mechanisms such as steam or gas turbines or engines and associated components can be used to drive compressor 108.

Compressor 108 compresses a refrigerant vapor and delivers the compressed vapor to condenser 112 through a discharge line. In an exemplary embodiment, compressor 108 can be a centrifugal compressor. The refrigerant vapor delivered by compressor 108 to condenser 112 transfers heat to a fluid, e.g., water or air. The refrigerant vapor condenses to a refrigerant liquid in condenser 112 as a result of the heat transfer with the fluid. The liquid refrigerant from condenser 112 flows through an expansion device (not shown) to an evaporator 126. The liquid refrigerant delivered to evaporator 126 absorbs heat from a fluid, e.g., air or water and undergoes a phase change to a refrigerant vapor. The vapor refrigerant exits evaporator 126 and returns to compressor 108 by a suction line to complete the cycle.

In an exemplary embodiment shown in FIG. 1, the refrigerant vapor in condenser 112 enters into the heat exchange relationship with water, flowing through a heat-exchanger 116 connected to a cooling tower 122. The refrigerant vapor in condenser 112 undergoes a phase change to a refrigerant liquid as a result of the heat exchange relationship with the water in heat-exchanger coil. Evaporator 126 can include a heat-exchanger 128 having a supply line 128S and a return line 128R connected to a cooling load 130. Heat-exchanger 128 can include a plurality of tube bundles within evaporator 126. A secondary liquid, e.g., water, ethylene, calcium chloride brine, sodium chloride brine or any other suitable secondary liquid, travels into evaporator 126 via return line 128R and exits evaporator 126 via supply line 128S. The liquid refrigerant in evaporator 126 enters into a heat exchange relationship with the secondary liquid in heat-exchanger 128 to chill the temperature of the secondary liquid in heat-exchanger coil 128. The refrigerant liquid in evaporator 126 undergoes a phase change to a refrigerant vapor as a result of the heat exchange relationship with the secondary liquid in heat-exchanger coil 128.

At the input or inlet to compressor 108, there are one or more pre-rotation vanes (PRV) or inlet guide vanes 120 that are used to control the flow of refrigerant to compressor 108. An actuator is used to open pre-rotation vanes 120 to increase the amount of refrigerant to compressor 108 and thereby increase the capacity of system 100. Similarly, the actuator is used to close pre-rotation vanes 120 to decrease the amount of refrigerant to compressor 108 and thereby decrease the cooling capacity of system 100.

Figure 2:
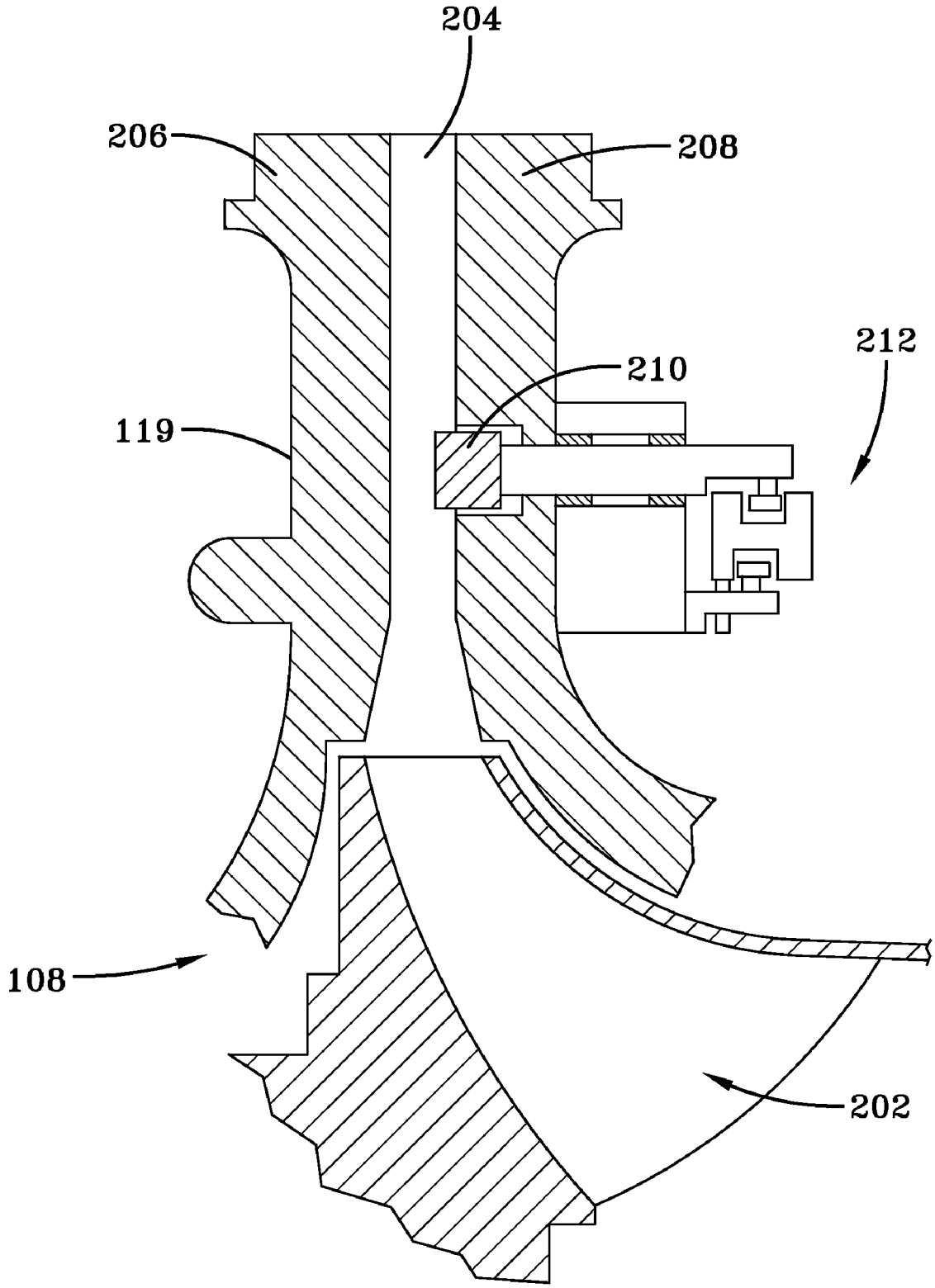
FIG. 2 shows a partial sectional view of an exemplary embodiment of a centrifugal compressor and diffuser.

FIG. 2 shows a partial sectional view of an exemplary embodiment of a centrifugal compressor and diffuser. Compressor 108 includes an impeller 202 for compressing the refrigerant vapor. The compressed vapor then passes through a diffuser 119. Diffuser 119 can be a vaneless radial diffuser having a variable geometry. The variable geometry diffuser (VGD) 119 has a diffuser space 204 formed between a diffuser plate 206 and a nozzle base plate 208 for the passage of the refrigerant vapor. Nozzle base plate 208 is configured for use with a diffuser ring 210. Diffuser ring 210 is used to control the velocity of refrigerant vapor that passes through diffuser space or passage 204. Diffuser ring 210 can be extended into diffuser passage 204 to increase the velocity of the vapor flowing through the passage and can be retracted from diffuser passage 204 to decrease the velocity of the vapor flowing through the passage. Diffuser ring 210 can be extended and retracted using an adjustment mechanism 212 driven by an electric motor to provide the variable geometry of diffuser 119. A more detailed description of the operation and components of one exemplary variable geometry diffuser is provided in U.S. Pat. No. 6,872,050, issued on Mar. 29, 2005, which patent is hereby incorporated by reference.

Control panel 140 has an A/D converter 148 that can receive input signals from system 100 indicative of the performance of system 100. For example, the input signals received by control panel 140 can include the position of pre-rotation vanes 120, the temperature of the leaving chilled liquid temperature from evaporator 126, pressures of evaporator 126 and condenser 112, and an acoustic or sound pressure measurement in the compressor discharge passage. Control panel 140 also has an interface board 146 to transmit signals to components of system 100 to control the operation of system 100. For example, control panel 140 can transmit signals to control the position of pre-rotation vanes 120, to control the position of an optional hot gas bypass valve 134 (see FIG. 5), if present, and to control the position of diffuser ring 210 in variable geometry diffuser 119.

Control panel 140 uses a control algorithm(s) to control operation of system 100 and to determine when to extend and retract diffuser ring 210 in variable geometry diffuser 119 in response to particular compressor conditions in order to maintain system and compressor stability. Control panel 140 can use the control algorithm(s) to open and close the optional, hot gas bypass valve 134 (see FIGS. 5 through 7), if present, in response to particular compressor conditions in order to maintain system and compressor stability. In one embodiment, the control algorithm(s) can be computer programs stored in non-volatile memory 144 having a series of instructions executable by microprocessor 150. In one exemplary embodiment, the control algorithm is embodied in a computer program(s) and executed by microprocessor 150. However, it is to be understood that the control algorithm may be implemented and executed using digital and/or analog hardware. If hardware is used to execute the control algorithm, the corresponding configuration of control panel 140 can be changed to incorporate the necessary components and to remove any components that may no longer be required, e.g. A/D converter 148.

Figure 3:
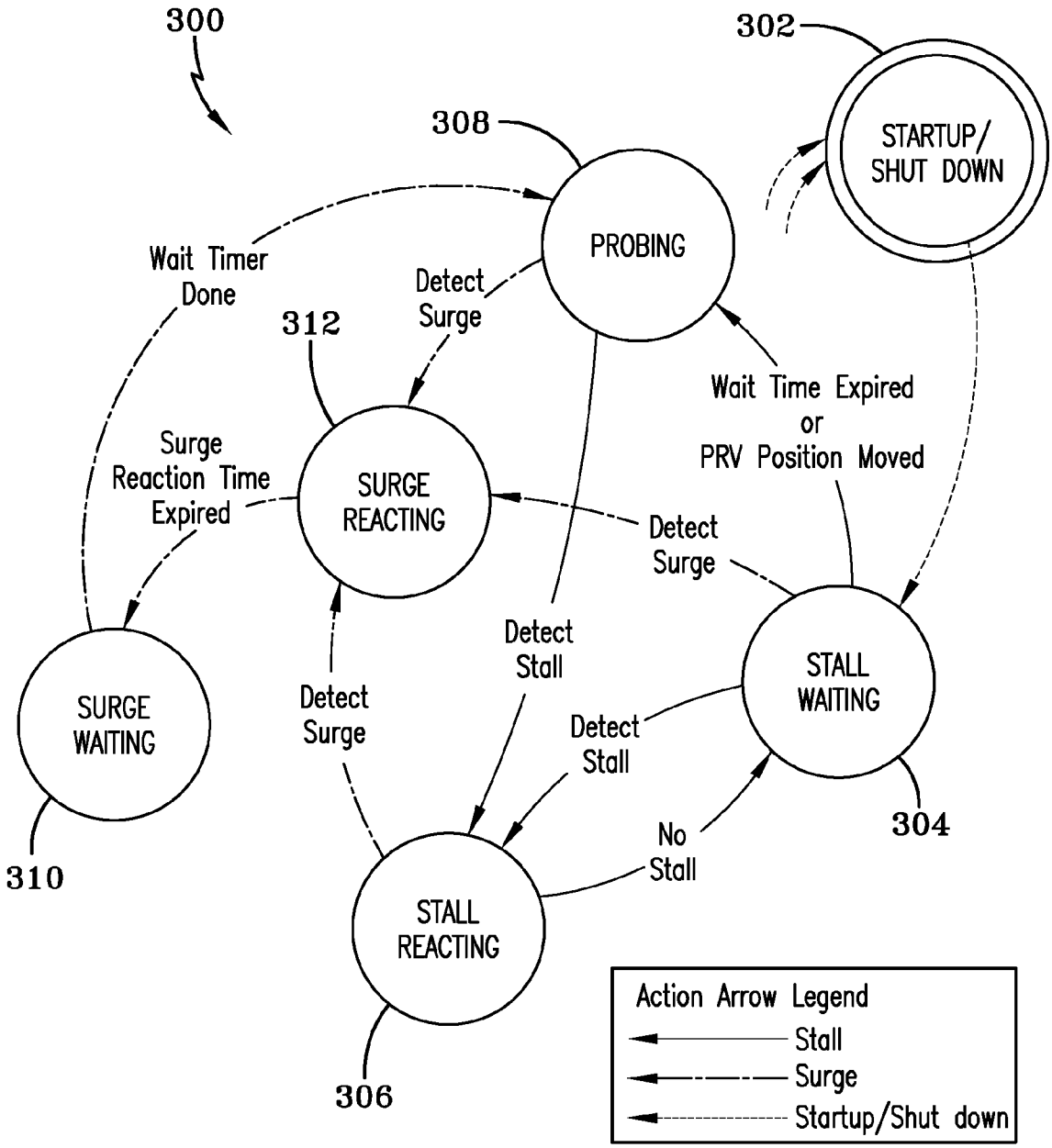
FIG. 3 shows an exemplary state diagram for a control system for the vapor compression system of FIG. 1.

FIGS. 3, 4, 6 and 7 are exemplary state diagram representations of stability control algorithms for maintaining compressor and system stability. The stability control algorithms may be executed as separate programs with respect to the other control algorithms for the system, e.g., an operational control algorithm, or the stability control algorithm can be incorporated into the other control algorithms of the system. As shown in FIG. 3, a state diagram 300 for an exemplary embodiment of the stability control algorithm to provide stability control to system 100 of FIG. 1 can have six control states. The control states include: a startup/shutdown state 302; a stall waiting state 304; a stall reacting state 306; a probing state 308; a surge waiting state 310; and a surge reacting state 312. Each control state can include one or more programs or algorithms or other control devices or equipment to execute the corresponding control operations for the particular control state.

The startup/shutdown state 302 is the first and last control state in stability control algorithm 300 during operation of system 100. Upon starting or initiating system 100 from an inactive state, stability control algorithm 300 enters the startup/shutdown state 302. Similarly, when system 100 is to be stopped or shutdown, startup/shutdown state 302 is entered from any one of the other control states in stability control algorithm 300 in response to a shutdown command from another control algorithm controlling system 100 or stability control algorithm 300. Stability control algorithm 300 remains in startup/shutdown state 302 until compressor 108 is started. In startup/shutdown state 302, diffuser ring 210 of variable geometry diffuser 119 is moved to a fully open or retracted position to thereby fully open diffuser space 204.

Stall waiting state 304 is entered after compressor 108 has started. Stall waiting state 304 can be entered following the correction of a stall condition in stall reacting state 306. The stability control algorithm 300 remains in stall waiting state 304 until one of the following conditions occurs: a predetermined stall waiting period expires; a surge condition is detected; a stall condition is detected; or pre-rotation vanes 120 are moved more than a predetermined PRV offset amount. The movement of pre-rotation vanes 120 can be an indicator that compressor conditions (e.g., flow and/or head) are changing and may require adjustment of variable geometry diffuser 119. According to an exemplary embodiment, the predetermined stall waiting period can range from about 0.5 minutes to about 15 minutes, and can be about 10 minutes, and the predetermined PRV offset amount can range from 0% to about 5% of the range of pre-rotation vane motion, and can be about 3%. In stall waiting state 304, diffuser ring 210 of variable geometry diffuser 119 is held or maintained in the same position that diffuser ring 210 of variable geometry diffuser 119 had in the previous state to thereby hold or maintain the opening in diffuser space 204.

Stall reacting state 306 is entered in response to the detection of stall in compressor 108 in either stall waiting state 304 or probing state 308. A more detailed description of the process and components for an exemplary technique for detecting stall in a compressor is provided in U.S. Pat. No. 6,857,845, issued on Feb. 22, 2005, which patent is hereby incorporated by reference. However, it is to be understood that any suitable stall detection technique can be used to detect stall in the system. Stability control algorithm 300 remains in stall reacting state 306 until the stall condition that is detected in compressor 108 is corrected or remedied or until a surge condition is detected in compressor 108. According to an exemplary embodiment, the stall condition is considered corrected or remedied in response to a corresponding stall sensor voltage being less than a predetermined stall minimum threshold voltage, which predetermined stall minimum threshold voltage can range from about 0.4 V to about 0.8 V, and can be about 0.6 V. In stall reacting state 306, diffuser ring 210 of variable geometry diffuser 119 is continuously extended toward a closed position to thereby close the opening in diffuser space 204 until the stall condition that has been detected in compressor 108 is corrected or remedied. Upon correcting or remedying the stall condition in stall reacting state 306, stability control algorithm 300 returns to stall waiting state 304.

Probing state 308 is entered in response to the expiration of the predetermined stall waiting period or the movement of pre-rotation vanes 120 by more than the predetermined PRV offset amount in stall waiting state 304. Probing state 308 can be entered following the expiration of a predetermined surge waiting period in surge waiting state 310. Stability control algorithm 300 remains in probing state 308 until a stall condition or a surge condition is detected in compressor 108. According to an exemplary embodiment, the stall condition is detected in response to a corresponding stall sensor voltage being greater than a predetermined stall maximum threshold voltage, which predetermined stall maximum threshold voltage can range from about 0.6 V to about 1.2 V, and can be about 0.8 V. In probing state 308, diffuser ring 210 of variable geometry diffuser 119 is opened or retracted to thereby increase the opening in diffuser space 204 until a surge condition or stall condition is detected in compressor 108. According to an exemplary embodiment, diffuser ring 210 of variable geometry diffuser 119 is opened or retracted in incremental amounts or steps triggered by pulses having a predetermined pulse interval that can range from about 0.5 seconds to about 5 seconds and can be about 1 or 2 seconds. At lower compressor loads, e.g., less than 70% of compressor capacity, a stall condition is typically detected and controlled before a surge condition can occur. However, at higher compressor loads, e.g., more than 70% of compressor capacity and very high heads or lifts, a surge condition can occur while in probing state 308, which may be momentary in nature and not detected as stall noise.

Surge reacting state 312 is entered in response to the detection of surge in compressor 108 in either stall waiting state 304, stall reacting state 306 or probing state 308. A more detailed description of the process and components for an exemplary technique for detecting surge in compressor 108 is provided in U.S. Pat. No. 6,427,464, which patent is hereby incorporated by reference. However, it is to be understood that any suitable surge detection technique can be used with the system. Stability control algorithm 300 remains in surge reacting state 312 until a predetermined surge reaction time has expired. According to an exemplary embodiment, the predetermined surge reaction time can range from about 1 second to about 30 seconds, and can be about 5 seconds. In surge reacting state 312, diffuser ring 210 of variable geometry diffuser 119 is continuously extended toward a closed position over the predetermined surge reaction time period to thereby reduce diffuser space or gap 204 to provide a more stable compressor operating capacity. The surge reaction time period can vary depending on overall speed of variable geometry diffuser ring mechanism 212 and drive actuator motor, and the desired VGD ring 210 movement needed to achieve surge stability.

Surge waiting state 310 is entered upon the correcting or remedying of a surge condition in compressor 108 in surge reacting state 312. The stability control algorithm 300 remains in surge waiting state 310 until a predetermined surge waiting period expires or compressor 108 enters into another surge condition. According to an exemplary embodiment, the predetermined surge waiting period can range from about 0.5 minutes to about 15 minutes, and can be about 10 minutes. In surge waiting state 310, diffuser ring 210 of variable geometry diffuser 119 is held or maintained in the same position that diffuser ring 210 of variable geometry diffuser 119 had in the previous state to thereby hold or maintain the opening in diffuser space 204. In an exemplary embodiment, stability control algorithm 300 may re-enter surge reacting state 312 in response to the detection of another surge condition in surge waiting state 310. Alternatively, another control algorithm may be used in response to the detection of another surge condition in surge waiting state 310. The surge events may be counted independently or as part of the control algorithm to determine when to shutdown compressor 108. In the event of continued surges in a short time period, stability control algorithm 300 or another control algorithm may provide alarms or shutdown protection of compressor 108 to avoid damaging compressor 108. Otherwise, stability control algorithm 300 enters probing state 308 in response to the expiration of the predetermined surge waiting period in surge waiting state 310.

Figure 4:
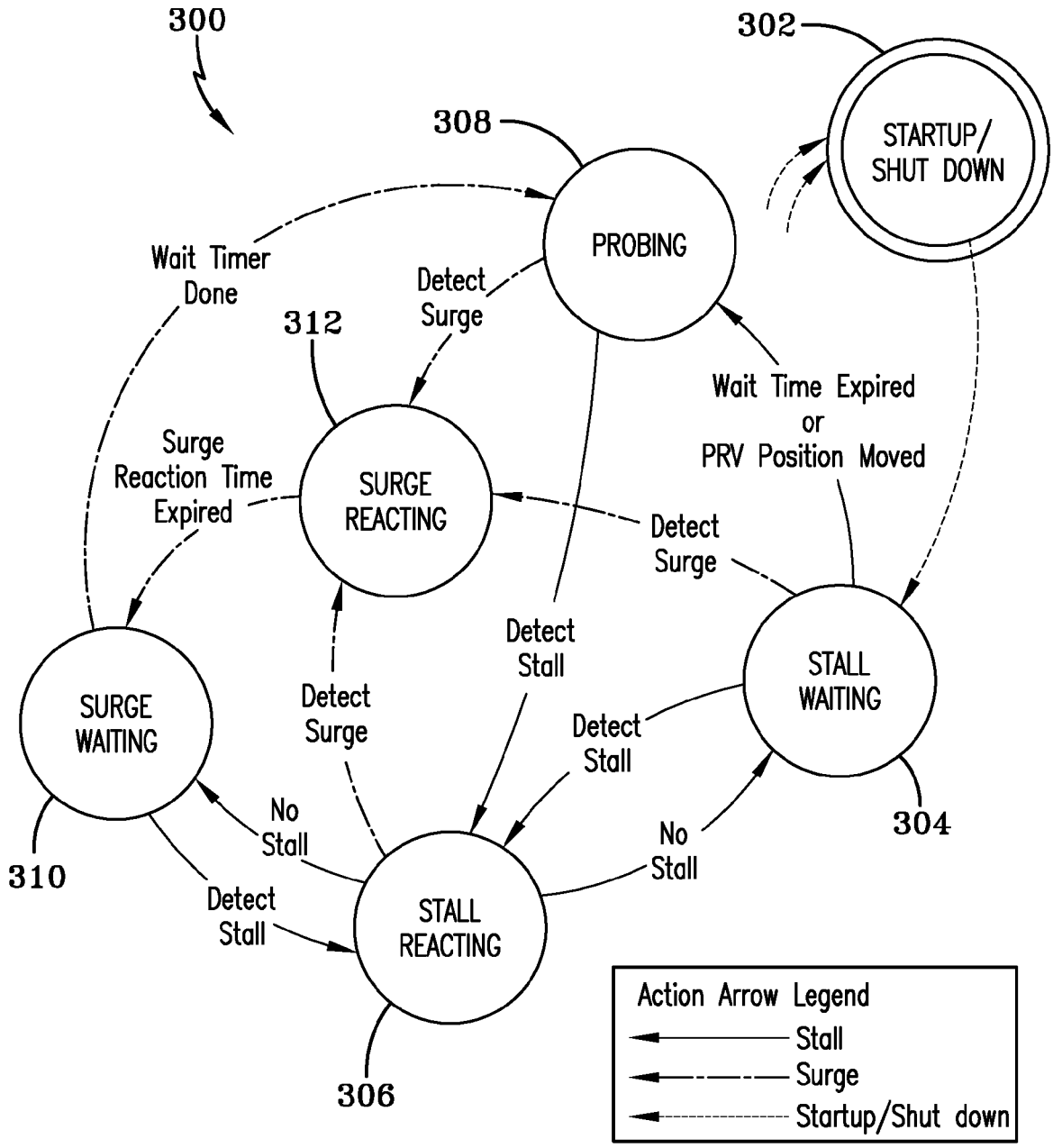
FIG. 4 shows another exemplary state diagram for a control system for the vapor compression system of FIG. 1.

FIG. 4 shows another exemplary state diagram for a control system similar to the state control diagram of FIG. 3 except that stability control algorithm 300 remains in surge waiting state 310 until a predetermined surge waiting period expires, a stall condition is detected or compressor 108 enters into another surge condition and stability control algorithm 300 remains in stall reacting state 306 until the stall condition that is detected in compressor 108 (either from surge waiting state 310, probing state 308 or stall waiting state 304) is corrected or remedied or until a surge condition is detected in compressor 108. If a stall condition occurs while in surge waiting state 310, stability control algorithm 300 pauses or suspends the timer for the surge waiting period in surge waiting state 310 and enters stall reacting state 306. Stability control algorithm 300 remains in stall reacting state 306 until the stall condition that is detected in compressor 108 from surge waiting state 310 is corrected or remedied or until a surge condition is detected in compressor 108. When the stall condition that is detected in compressor 108 from surge waiting state 310 is corrected or remedied, stability control algorithm 300 re-enters surge waiting state 310 and resumes the timer for the surge waiting period in surge waiting state 310. In another exemplary embodiment, when stability control algorithm 300 re-enters surge waiting state 310, the timer for the surge waiting period can be restarted to remain in surge waiting state 310 for the full time period.

Figure 5:
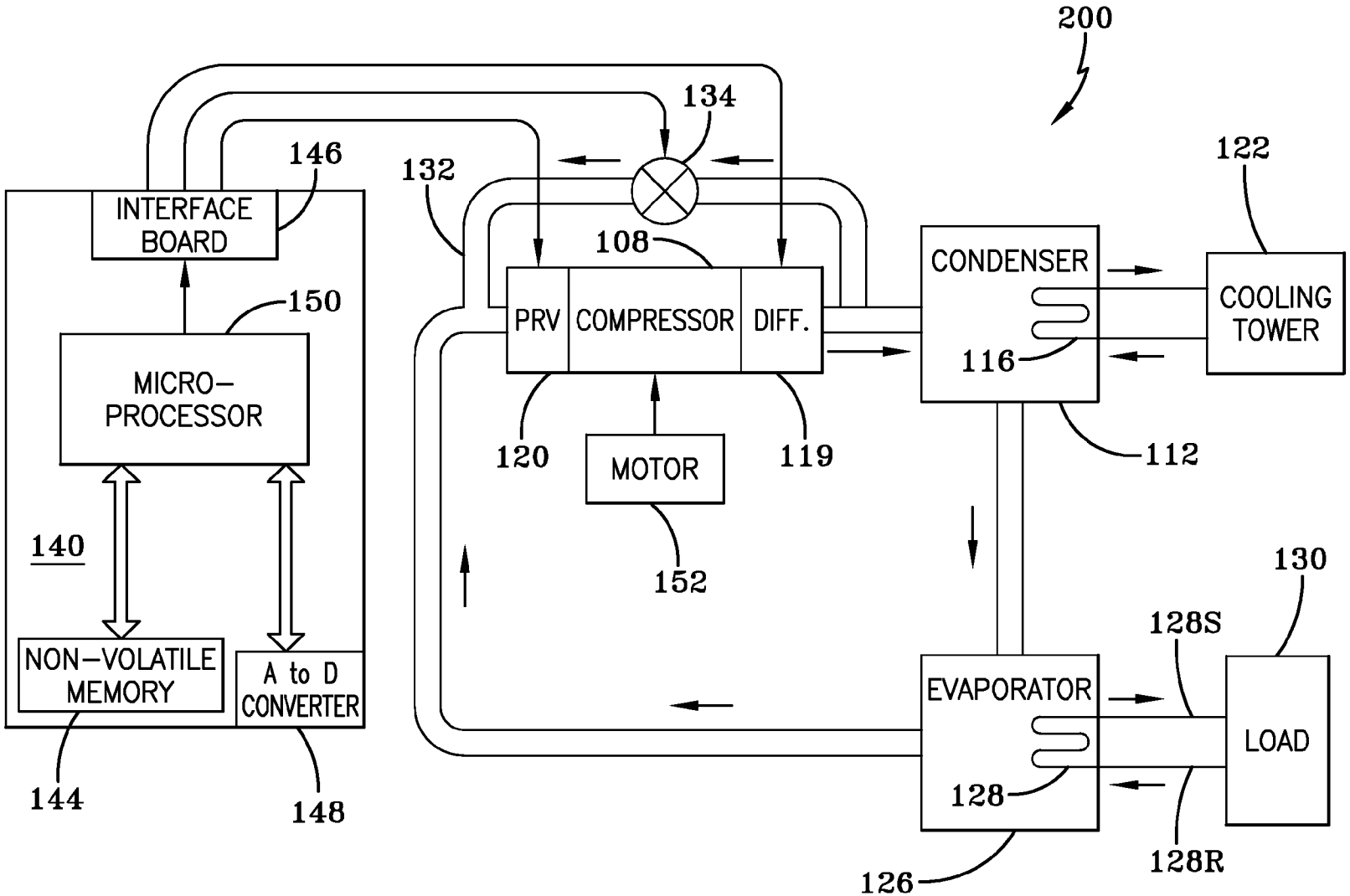
FIG. 5 schematically shows another exemplary embodiment of a vapor compression system.

FIG. 5 schematically shows another exemplary embodiment of a vapor compression system. The vapor compression system 200 illustrated in FIG. 5 is similar to the vapor compression system 100 illustrated in FIG. 1 except that a hot gas bypass line 132 and a hot gas bypass (HGBP) valve 134 are connected between the outlet or discharge of compressor 108 and the inlet of pre-rotation vanes 120 to permit compressed refrigerant from the compressor discharge to be diverted or recycled back to the inlet of compressor 108, when HGBP valve 134 is open, in response to the presence of a surge condition. The position of HGBP valve 134 is controlled to regulate the amount of compressed refrigerant, if any, which is provided to compressor 108. A description of an exemplary control process for a HGBP valve is provided in U.S. Pat. No. 6,427,464, which patent is hereby incorporated by reference. However, it is to be understood that any suitable HGBP valve and corresponding control process can be used with the system.

Figure 6:
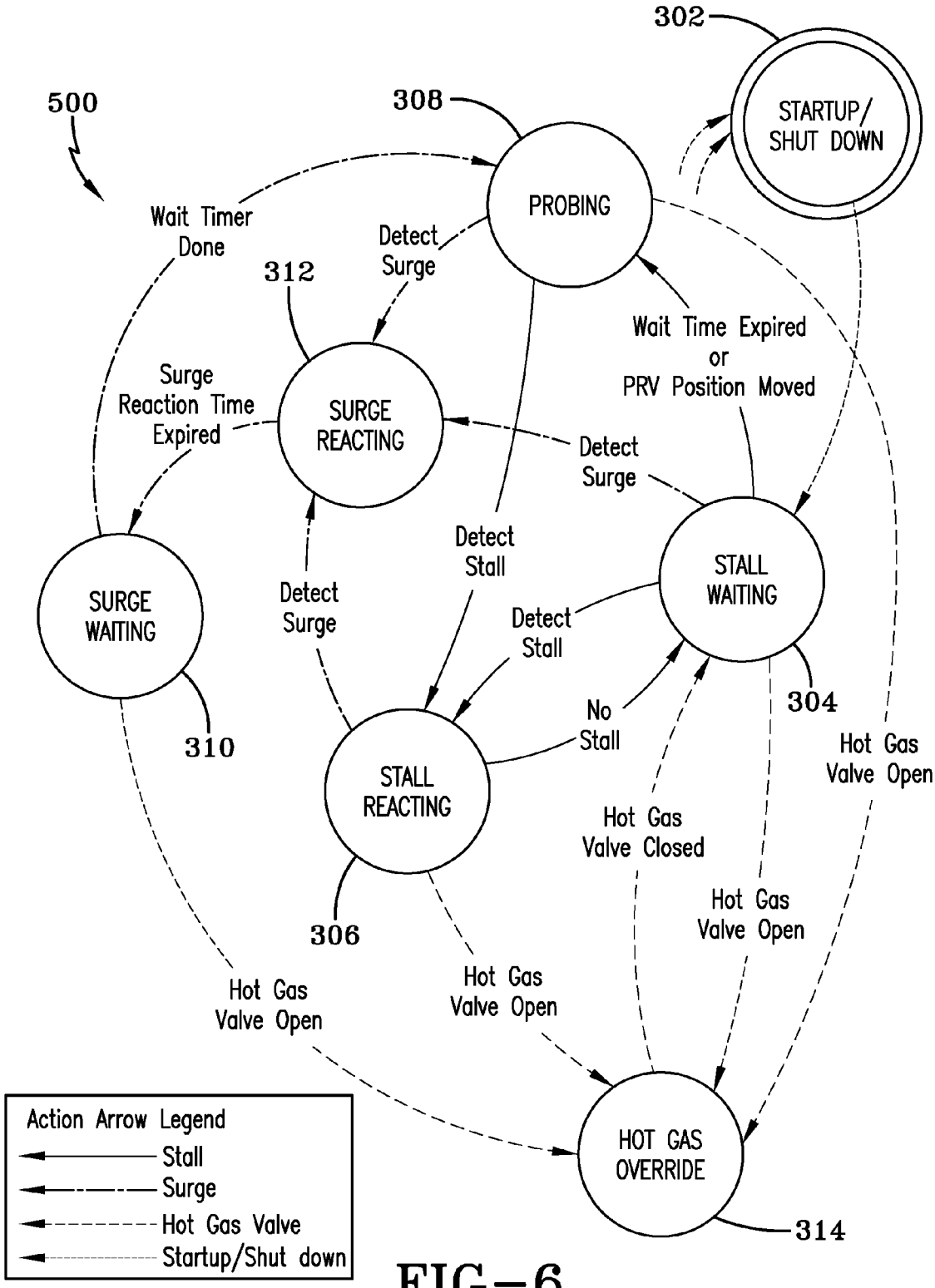
FIG. 6 shows an exemplary state diagram for a control system for the vapor compression system of FIG. 5.

FIG. 6 shows an exemplary state diagram for a control system for the vapor compression system of FIG. 5. As shown in FIG. 6, state diagram 500 for an embodiment of the stability control algorithm for providing stability control to system 200 of FIG. 5 is similar to the state diagram for stability control algorithm 300 illustrated in FIG. 3 and described in detail above except for the addition of a seventh control state, a hot gas override state 314 and the corresponding intra-connections to hot gas override state 314.

Hot gas override state 314 is entered in response to compressor 108 experiencing a second surge condition while in surge waiting state 310 instead of possibly returning to surge reacting state 312 or using another control algorithm in response to the detection of another surge condition as described above with respect to stability control algorithm 300. Stability control algorithm 500 can enter hot gas override state 314 from stall waiting state 304, stall reacting state 306 or probing state 308 in response to the detection of a HGBP valve open command from another control algorithm controlling the system. The HGBP valve open command can be generated as described in U.S. Pat. No. 6,427,464, which patent is hereby incorporated by reference, or using any other suitable HGBP valve control process. The stability control algorithm 500 remains in hot gas override state 314 until HGBP valve 134 returns to a closed position. In hot gas override state 314, diffuser ring 210 of variable geometry diffuser 119 is held or fixed in position whenever HGBP valve 134 is in an open position to thereby hold or fix the opening in diffuser space 204 in order to keep variable geometry diffuser 119 at a position of similar surge stability when the system head is later lowered and HGBP valve 134 is closed. Upon the closing of HGBP valve 134 in hot gas override state 314, stability control algorithm 500 enters stall waiting state 304.

Figure 7:
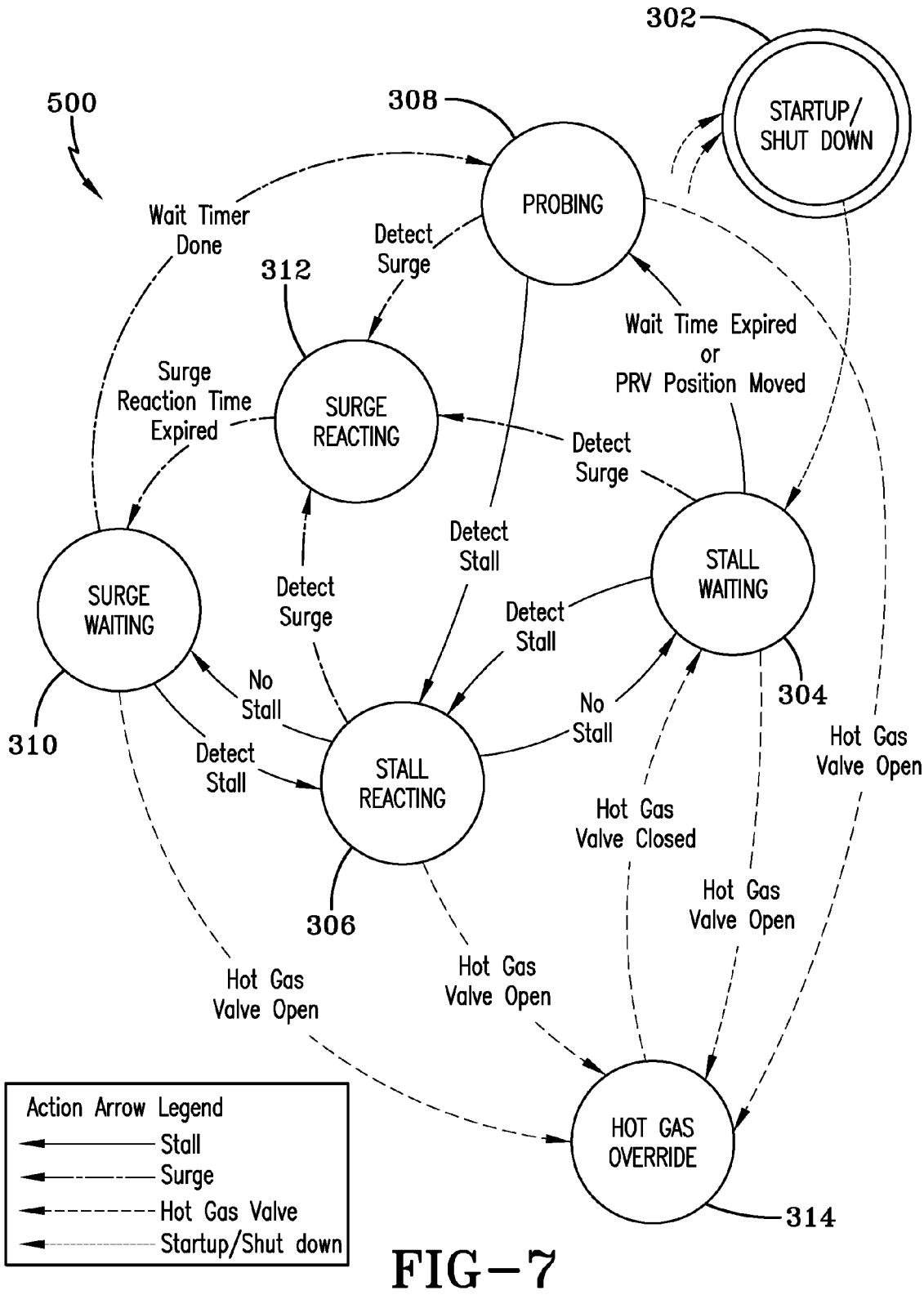
FIG. 7 shows another exemplary state diagram for a control system for the vapor compression system of FIG. 5.

FIG. 7 shows another exemplary state diagram for a control system similar to FIG. 6 except that stability control algorithm 500 remains in surge waiting state 310 until a predetermined surge waiting period expires, a stall condition is detected or compressor 108 enters into another surge condition and stability control algorithm 500 remains in stall reacting state 306 until the stall condition that is detected in compressor 108 (either from surge waiting state 310, probing state 308 or stall waiting state 304) is corrected or remedied or until a surge condition is detected in compressor 108. If a stall condition occurs while in surge waiting state 310, stability control algorithm 500 pauses or suspends the timer for the surge waiting period in surge waiting state 310 and enters stall reacting state 306. Stability control algorithm 500 remains in stall reacting state 306 until the stall condition that is detected in compressor 108 from surge waiting state 310 is corrected or remedied or until a surge condition is detected in compressor 108. When the stall condition that is detected in compressor 108 from surge waiting state 310 is corrected or remedied, stability control algorithm 500 re-enters surge waiting state 310 and resumes the timer for the surge waiting period in surge waiting state 310. In another exemplary embodiment, when stability control algorithm 500 re-enters surge waiting state 310, the timer for the surge waiting period can be restarted to remain in surge waiting state 310 for the full time period.

In an exemplary embodiment, motor 152 is connected to a variable speed drive (not shown) that varies the speed of motor 152. The varying of the speed of the compressor by the variable speed drive (VSD) affects both the refrigerant vapor flow rate through the system and the compressor's stability relative to surge conditions. Stability control algorithms 300, 500 may be used in conjunction with a variable speed drive. When a variable speed drive is used, adaptive capacity control logic utilizing system operating parameters and compressor PRV position information can be used to operate the compressor at a faster speed when a surge is detected while stability control algorithms 300, 500 are in surge reacting state 312. Past performance parameters can be mapped and stored in memory to avoid future surge conditions by the adaptive capacity control logic. A description of an exemplary adaptive capacity control process is provided in U.S. Pat. No. 4,608,833 which patent is hereby incorporated by reference. However, it is to be understood that any suitable adaptive capacity control process can be used with the system.

While only certain features and embodiments of the invention have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A control system to maintain stable operation of a compressor comprising:

at least one first control state configured to close a flow passage of a diffuser of the compressor in response to detecting one of a stall condition or a surge condition in the compressor;

a second control state configured to open the flow passage of the diffuser of the compressor in response to determining an absence of a stall condition or a surge condition; and the second control state being prevented from engagement in response to being in the at least one first control state.

2. The system of claim 1 wherein the at least one first control state comprises:

a stall reacting state, the stall reacting state being entered in response to detecting a stall condition; and a surge reacting state, the surge reacting state being entered in response to detecting a surge condition.

3. The system of claim 2 wherein:

the surge reacting state is configured to continuously close the flow passage of the diffuser for a predetermined surge reaction time period; and the stall reacting state is configured to continuously close the flow passage of the diffuser until the detected stall condition is corrected or a surge condition is detected.

4. The system of claim 3 further comprising a surge waiting state configured to maintain a dimension of the flow passage of the diffuser in response to a surge condition being corrected in the surge reacting state.

5. The system of claim 4 wherein the surge waiting state is configured to maintain a dimension of the flow passage of the diffuser until a predetermined surge waiting period expires, a surge condition occurs or a stall condition occurs.

6. The system of claim 5 further comprising a hot gas override state configured to maintain a dimension of the flow passage of the diffuser in response to the occurrence of a surge condition in the surge waiting state.

7. The system of claim 5 wherein the stall reacting state is entered in response to a stall condition occurring in the surge waiting state and the surge waiting state is entered in response to the stall condition being corrected in the stall reacting state.

8. The system of claim 3 further comprising a stall waiting state configured to maintain a dimension of the flow passage of the diffuser in response to one of correction of a stall condition in the stall reacting state or starting of a compressor.

9. The system of claim 8 wherein the stall waiting state is configured to maintain a position of the flow passage of the diffuser until one of a predetermined stall waiting period expires, pre-rotation vanes are adjusted more than a predetermined threshold amount, a stall condition occurs or a surge condition occurs.

10. The system of claim 1 wherein the second control state comprises a probing state configured to incrementally open the flow passage of the diffuser until a stall condition is detected or a surge condition is detected.

11. The system of claim 1 further comprising a startup state configured to fully open the flow passage of the diffuser prior to starting the compressor.

12. A method of providing stability control in a centrifugal compressor comprising:

repeatedly detecting for a surge condition during operation of the centrifugal compressor;

repeatedly detecting for a stall condition during operation of a centrifugal compressor;

closing a flow passage of a diffuser of the centrifugal compressor in response to detecting a surge condition or a stall condition in the centrifugal compressor;

opening the flow passage of the diffuser of the centrifugal compressor in response to detecting an absence of a stall condition or a surge condition; and preventing the opening the flow passage of the diffuser from occurring immediately after the closing a flow passage of a diffuser.

13. The method of claim 12 wherein opening the flow passage of the diffuser comprises incrementally opening the flow passage of the diffuser of the centrifugal compressor until one of a stall condition is detected or a surge condition is detected.

14. The method of claim 12 further comprising maintaining a dimension of the flow passage of the diffuser in response to a surge condition being corrected until a predetermined surge waiting period expires, a surge condition is detected or a stall condition is detected.

15. The method of claim 12 further comprising fully opening the flow passage of the diffuser in response to stopping the centrifugal compressor.

16. The method of claim 12 further comprising maintaining a position of the flow passage of the diffuser in response to one of correction of a stall condition or starting of a centrifugal compressor until one of a predetermined stall waiting period expires, pre-rotation vanes are moved more than a predetermined threshold amount, a stall condition is detected or a surge condition is detected.

17. A vapor compression system comprising:

a compressor, a first heat exchanger, and a second heat exchanger connected in a closed loop;

the compressor comprising:

an inlet to receive uncompressed vapor;

an outlet to discharge compressed vapor; and a diffuser being disposed near the outlet, the diffuser comprising a passageway configured to permit flow of compressed vapor to the outlet and a ring adjustably positioned in the passageway to vary a dimension of the passageway to control flow of compressed vapor through the passageway;

a control system to adjust the position of the ring in the passageway in response to one of a presence of stall conditions and surge conditions in the compressor or an absence of stall conditions and surge conditions in the compressor; and the control system being configured to prevent adjusting of the position of the ring in the passageway in response to the absence of stall conditions and surge conditions immediately after adjusting the position of the ring in the passageway in response to one of a presence of stall conditions and surge conditions.

18. The system of claim 17 wherein the control system extends the ring into the passageway in response to the presence of a surge condition or a stall condition.

19. The system of claim 18 wherein the control system continuously extends the ring into the passageway for a predetermined surge reaction time period in response to the detection of a surge condition and continuously extends the ring into the passageway in response to the detection of a stall condition until the detected stall condition is corrected or a surge condition is detected.

20. The system of claim 17 further comprising:

a hot gas bypass valve connected between the outlet and the inlet, the hot gas bypass valve being configured to permit a portion of the compressed refrigerant vapor to flow from the outlet to the inlet; and the control system maintains the ring in position in the passageway in response to the hot gas bypass valve being opened.

* * * * *